US006074045A

United States Patent [19]

Bergman et al.

[11] Patent Number: 6,074,045

[45] Date of Patent: Jun. 13, 2000

[54] PRINTHEAD STRUCTURE IN AN IMAGE RECORDING DEVICE

[75] Inventors: Karin V. Bergman; Anders G P Ingelhag, both of Gothenburg, Sweden

[73] Assignee: Array Printers AB, Vastra Frolunda, Sweden

[21] Appl. No.: 09/034,877

[22] Filed: Mar. 4, 1998

[51] Int. Cl.[7] ..... B41J 2/415

[52] U.S. Cl. ..... 347/55; 347/50; 347/120

[58] Field of Search ..... 347/55, 45, 47, 347/112, 141, 50, 40, 120

[56] References Cited

U.S. PATENT DOCUMENTS

| | | | |
|---|---|---|---|
| 3,566,786 | 3/1971 | Kaufer et al. | 101/152 |
| 3,689,935 | 9/1972 | Pressman et al. | 347/55 |
| 3,779,166 | 12/1973 | Pressman et al. | 347/124 |
| 3,815,145 | 6/1974 | Tisch et al. | 347/123 |
| 4,263,601 | 4/1981 | Nishimura et al. | 347/55 |
| 4,274,100 | 6/1981 | Pond | 347/74 |
| 4,353,080 | 10/1982 | Cross | 347/143 |
| 4,382,263 | 5/1983 | Fischbeck et al. | 347/55 |
| 4,384,296 | 5/1983 | Torpey | 347/77 |
| 4,386,358 | 5/1983 | Fischbeck | 347/55 |
| 4,470,056 | 9/1984 | Galetto et al. | 347/145 |
| 4,478,510 | 10/1984 | Fujii et al. | 347/55 |
| 4,491,794 | 1/1985 | Daley et al. | 324/228 |
| 4,491,855 | 1/1985 | Fujii et al. | 347/55 |
| 4,498,090 | 2/1985 | Honda et al. | 347/128 |

(List continued on next page.)

FOREIGN PATENT DOCUMENTS

| | | |
|---|---|---|
| 0345 024 A2 | 6/1989 | European Pat. Off. . |
| 0352 997 A2 | 1/1990 | European Pat. Off. . |
| 0377 208 A2 | 7/1990 | European Pat. Off. . |
| 0389 229 | 9/1990 | European Pat. Off. . |
| 0660 201 A2 | 6/1995 | European Pat. Off. . |
| 072 072 A2 | 7/1996 | European Pat. Off. . |
| 0 743 572 A1 | 11/1996 | European Pat. Off. . |
| 0752 317 A1 | 1/1997 | European Pat. Off. . |
| 0764 540 A2 | 3/1997 | European Pat. Off. . |
| 12 70 856 | 6/1968 | Germany . |
| 26 53 048 | 5/1978 | Germany . |
| 4426333 | 11/1969 | Japan . |
| 5555878 | 4/1980 | Japan . |
| 5584671 | 6/1980 | Japan . |
| 5587563 | 7/1980 | Japan . |

(List continued on next page.)

OTHER PUBLICATIONS

E. Bassous, et al., "The Fabrication of High Precision Nozzles by the Anisotropic Etching of (100) Silicon", *J. Electochem. Soc.: Solid–State Science and Technology*, vol. 125, No. 8, Aug. 1978, pp. 1321–1327.

Jerome Johnson, "An Etched Circuit Aperture Array for TonerJet® Printing", *IS&T's Tenth International Congress on Advances in Non–Impact Printing Technologies*, 1994, pp. 311–313.

"The Best of Both Worlds," Brochure of Toner Jet® by Array Printers, *The Best of Both Worlds*, 1990.

*Primary Examiner*—N. Le
*Assistant Examiner*—Hai C. Pham
*Attorney, Agent, or Firm*—Knobbe, Martens, Olson & Bear, LLP

[57] ABSTRACT

An image recording apparatus includes a toner particle source for delivering charged toner particles to an image receiving medium. The image recording apparatus further includes a printhead structure arranged between the toner particle source and the image receiving medium to modulate a transport of toner particles from the particle source to the image receiving medium. The printhead structure includes a substrate of electrically insulating material having a first surface facing the toner particle source and a second surface facing the image receiving member. A first cover layer of electrically insulating material is arranged on the first surface of the substrate. A plurality of apertures are arranged through the printhead structure. A first printed circuit including control electrodes is arranged between the substrate and the first cover layer to control the transport of toner through the apertures and a spacer layer of wear-resistant material at least partially coats the first cover layer to space the first cover layer from the toner particles on the particle source.

38 Claims, 8 Drawing Sheets

U.S. PATENT DOCUMENTS

| | | | |
|---|---|---|---|
| 4,511,907 | 4/1985 | Fukuchi | 347/12 |
| 4,525,727 | 6/1985 | Kohashi et al. | 347/12 |
| 4,571,601 | 2/1986 | Teshima | 347/33 |
| 4,675,703 | 6/1987 | Fotland | 347/127 |
| 4,717,926 | 1/1988 | Hotomi | 347/55 |
| 4,743,926 | 5/1988 | Schmidlin et al. | 347/55 |
| 4,748,453 | 5/1988 | Lin et al. | 347/41 |
| 4,814,796 | 3/1989 | Schmidlin | 347/55 |
| 4,831,394 | 5/1989 | Ochiai et al. | 347/55 |
| 4,860,036 | 8/1989 | Schmidlin | 347/55 |
| 4,903,050 | 2/1990 | Schmidlin | 347/55 |
| 4,912,489 | 3/1990 | Schmidlin | 347/55 |
| 5,028,812 | 7/1991 | Bartky | 347/241 |
| 5,036,341 | 7/1991 | Larsson | 347/55 |
| 5,038,159 | 8/1991 | Schmidlin et al. | 347/55 |
| 5,057,855 | 10/1991 | Damouth | 347/57 |
| 5,072,235 | 12/1991 | Slowik et al. | 347/19 |
| 5,073,785 | 12/1991 | Jansen et al. | 347/45 |
| 5,083,137 | 1/1992 | Badyal et al. | 347/14 |
| 5,095,322 | 3/1992 | Fletcher | 347/55 |
| 5,121,144 | 6/1992 | Larson et al. | 347/55 |
| 5,128,695 | 7/1992 | Maeda | 347/55 |
| 5,148,595 | 9/1992 | Doggett et al. | 29/840 |
| 5,170,185 | 12/1992 | Takemura et al. | 347/55 |
| 5,181,050 | 1/1993 | Bibl et al. | 347/148 |
| 5,204,696 | 4/1993 | Schmidlin et al. | 347/55 |
| 5,204,697 | 4/1993 | Schmidlin | 347/115 |
| 5,214,451 | 5/1993 | Schmidlin et al. | 347/55 |
| 5,229,794 | 7/1993 | Honman et al. | 347/55 |
| 5,235,354 | 8/1993 | Larson | 347/124 |
| 5,237,346 | 8/1993 | Da Costa et al. | 347/148 |
| 5,256,246 | 10/1993 | Kitamura | 216/17 |
| 5,257,045 | 10/1993 | Bergen et al. | 347/123 |
| 5,270,729 | 12/1993 | Stearns | 347/128 |
| 5,274,401 | 12/1993 | Doggett et al. | 347/148 |
| 5,307,092 | 4/1994 | Larson | 347/124 |
| 5,329,307 | 7/1994 | Takemura et al. | 347/151 |
| 5,374,949 | 12/1994 | Wada et al. | 347/112 |
| 5,386,225 | 1/1995 | Shibata | 347/55 |
| 5,402,158 | 3/1995 | Larson | 347/151 |
| 5,414,500 | 5/1995 | Furukawa | 399/285 |
| 5,446,478 | 8/1995 | Larson | 347/158 |
| 5,450,115 | 9/1995 | Bergen et al. | 347/123 |
| 5,453,768 | 9/1995 | Schmidlin | 347/55 |
| 5,473,352 | 12/1995 | Ishida | 347/55 |
| 5,477,246 | 12/1995 | Hirabayashi et al. | 347/12 |
| 5,477,250 | 12/1995 | Larson | 347/55 |
| 5,506,666 | 4/1996 | Masuda et al. | 399/335 |
| 5,508,723 | 4/1996 | Maeda | 347/55 |
| 5,515,084 | 5/1996 | Larson | 347/55 |
| 5,526,029 | 6/1996 | Larson et al. | 347/55 |
| 5,558,969 | 9/1996 | Uyttendaele et al. | 430/124 |
| 5,559,586 | 9/1996 | Wada | 399/271 |
| 5,600,355 | 2/1997 | Wada | 347/55 |
| 5,614,932 | 3/1997 | Kagayama | 347/55 |
| 5,617,129 | 4/1997 | Chizuk, Jr. et al. | 347/123 |
| 5,625,392 | 4/1997 | Maeda | 347/55 |
| 5,640,185 | 6/1997 | Kagayama | 347/55 |
| 5,650,809 | 7/1997 | Kitamura | 347/55 |
| 5,666,147 | 9/1997 | Larson | 347/112 |
| 5,677,717 | 10/1997 | Ohashi | 347/69 |
| 5,708,464 | 1/1998 | Desie | 347/55 |
| 5,774,159 | 6/1998 | Larson | 347/151 |
| 5,805,185 | 9/1998 | Kondo | 347/55 |
| 5,818,480 | 10/1998 | Bern et al. | 347/55 |
| 5,818,490 | 10/1998 | Larson | 347/151 |
| 5,847,733 | 12/1998 | Bern | 347/55 |
| 5,905,516 | 5/1999 | Kagayama | 347/55 |

FOREIGN PATENT DOCUMENTS

| | | |
|---|---|---|
| 5689576 | 7/1981 | Japan . |
| 58044457 | 3/1983 | Japan . |
| 58155967 | 9/1983 | Japan . |
| 62-248662 | 10/1987 | Japan . |
| 6213356 | 11/1987 | Japan . |
| 01120354 | 5/1989 | Japan . |
| 05220963 | 8/1990 | Japan . |
| 04189554 | 8/1992 | Japan . |
| 4-268591 | 9/1992 | Japan . |
| 4282265 | 10/1992 | Japan . |
| 5208518 | 8/1993 | Japan . |
| 93331532 | 12/1993 | Japan . |
| 94200563 | 8/1994 | Japan . |
| 9048151 | 2/1997 | Japan . |
| 09118036 | 5/1997 | Japan . |
| 2108432 | 5/1983 | United Kingdom . |
| 9014960 | 12/1990 | WIPO . |

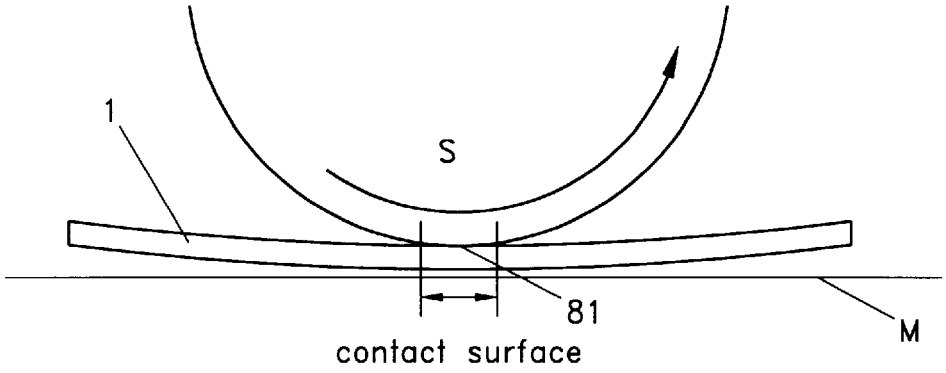
FIG. 11
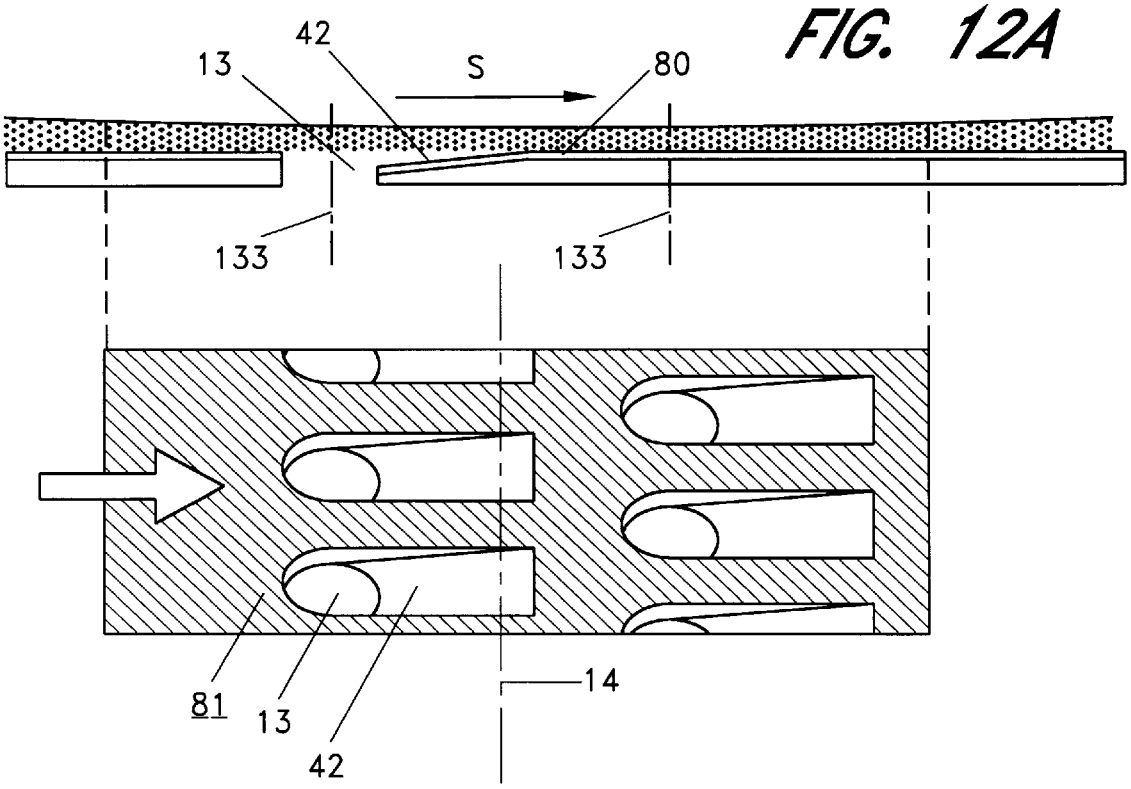
FIG. 12A
FIG. 12B

PRINTHEAD STRUCTURE IN AN IMAGE RECORDING DEVICE

BACKGROUND OF THE INVENTION

1. Field of the Invention

The present invention is within the field of electrographical printing devices. More specifically, the invention relates to an apertured printhead structure brought into cooperation with a particle source to modulate a stream of toner particles from the particle source through the apertured printhead structure.

2. Description of the Related Art

U.S. Pat. No. 5,036,341 granted to Larson discloses a direct electrostatic printing device and a method to produce text and pictures with toner particles on an image receiving substrate directly from computer generated signals. The Larson patent discloses a method in which an electrode matrix, arranged between a back electrode and a rotating particle carrier, generates a pattern of electrostatic fields which, due to control in accordance with an image information, modulate a transport of toner particles toward the back electrode. An electrostatic field on the back electrode attracts the toner particles from the surface of the particle carrier to create a particle stream toward the back electrode. The particle stream is modulated by voltage sources which apply an electric potential to selected individual control electrodes to create electrostatic fields which either permit or restrict the transport of toner particles from the particle carrier through the electrode matrix, In effect, these electrostatic fields "open" or "close" selected apertures in the electrode matrix to the passage of toner particles by influencing the attractive force from the back electrode. The modulated stream of charged toner particles allowed to pass through the opened apertures impinges upon a print-receiving medium interposed in the particle stream to provide line-by-line scan printing to form a visible image.

An electrode matrix for use in direct electrostatic printing devices may take on many designs, such as a lattice of intersecting wires arranged in rows and columns, or a screen-shaped, apertured printed circuit. Generally, the matrix is formed of a thin, flexible substrate of electrically insulating material, such as polyimide, provided with a plurality of apertures and overlaid with a printed circuit of control electrodes arranged in connection to the apertures, such that each aperture is surrounded by an individually addressable control electrode.

An essential requirement of the aforementioned method is to maintain a constant, uniform gap distance between the electrode matrix and the particle carrier. The gap distance can vary from machine to machine because it is determined by a combination of independent factors such as manufacturing variations in the size and placement of the particle carrier and the electrode matrix, as well as the thickness of the toner layer on the particle carrier.

U.S. Pat. No. 5,666,147, also granted to Larson, discloses improved means for maintaining a constant minimal gap between the electrode matrix and the particle carrier, while providing a uniform toner layer on the surface of the particle carrier. According to that patent, a spacer is mounted on the electrode matrix on the side facing the particle carrier to engage the carrier on it, and the portion of the array supporting the spacer can move slightly radially towards and away from the carrier to accommodate imperfections in the carrier surface and variations in the toner layer thickness. The gap distance is thus maintained at a constant value according to the thickness of the spacer, independent of the thickness of the particle layer.

However, even if undesired distance variations of the gap between the electrode matrix and the particle carrier are considerably reduced by spacers, there is still a need for improving the material composition and the configuration of the spacers, to obtain required properties such as, for example, a combination of high hardness, low surface roughness, low friction and chemical inertness.

SUMMARY OF THE INVENTION

The present invention satisfies a need for an improved method for accurately positioning an apertured printhead structure in cooperation with a particle source having a outer surface caused to move in relation to the printhead structure. A toner particle layer is conveyed in frictional contact between the outer surface of the particle source and a contact surface of the printhead structure. The apertures through the printhead structure are sunken in depression areas and thereby spaced from the toner particle layer.

According to the present invention, each aperture in the printhead structure is positioned at a constant, predetermined gap distance from the particle source, which gap distance is determined by a depth of the depression areas with respect to the contact surface of the printhead structure. The present invention further satisfies a need for providing a uniformly thick layer of charged particles on the outer surface of the particle source, from which layer an intended amount of charged particles are allowed to be released upon passage over each single aperture.

The present invention relates to an apertured printhead structure in an image recording apparatus which includes at least one print station and an image receiving medium caused to move in relation to the print station. The print station includes a particle source, such as a rotating toner particle carrier, arranged adjacent to the image receiving medium. The printhead structure is interposed between the particle source and the image receiving medium.

According to the present invention, the printhead structure comprises a flexible, electrically insulating substrate having a first surface facing the particle source and a second surface facing the image receiving medium; a first cover layer arranged on the first surface of the substrate; and a first printed circuit arranged between the substrate and the first cover layer. Depression areas are arranged on the top surface of the first cover layer. The printhead structure further includes a plurality of apertures arranged through the printhead structure. The apertures are disposed in depression areas, the part of the aperture facing the particle source being thereby sunken in the thickness of the printhead structure.

According to the present invention, the printhead structure further includes a spacer layer of wear resistant material, such as amorphous carbon, arranged on at least a portion of the top surface of the first cover layer. The spacer layer has a contact surface brought in direct contact with the toner layer on the outer surface of the particle source. The contact surface surrounds at least a part of each depression area, whereby all apertures can be uniformly spaced from the toner layer. The contact surface extends preferably on each transverse side of the depression areas, and on a upstream side of the depression areas with respect to the motion of the particle source.

According to a preferred embodiment of the preferred invention, the printhead structure further includes a second cover layer arranged on the second surface of the substrate; and a second printed circuit arranged between the substrate and the second cover layer, and including segmented deflection electrodes. The printhead structure is brought in cooperation with variable control voltage sources connected to the control electrodes to supply control potentials which control the amount of toner particles to be transported from the toner particle layer through the apertures toward the image receiving medium. The segmented deflection electrodes are connected to deflection voltage sources which supply deflection voltage pulses to sequentially modify the transport trajectory of the toner particles, so as to obtain several addressable pixel locations through each aperture.

BRIEF DESCRIPTION OF THE DRAWINGS

These and other objects, specific advantages, and features of the present invention will become more apparent upon a reading of the following detailed description of specific examples and embodiments thereof, when read in conjunction with an examination of the accompanying drawings, wherein like reference numerals designate like parts throughout. The dimensions in the drawings are not to scale.

FIG. 1 shows the part of the printhead structure facing the particle source.

FIG. 5 shows the part of the cover layer facing the particle source.

FIG. 11 is a schematic illustration of the position of a printhead structure with respect to a rotating toner particle carrier. FIG. 11 is a longitudinal section view across the printhead structure and the part of the toner particle carrier contacting the printhead structure.

FIG. 12*a* is a partial enlargement of FIG. 11 showing the contact surface between the toner particle carrier and the printhead structure.

FIG. 12*b* is a partial perspective view of a portion of the contact surface of FIG. 12*a*.

DESCRIPTION OF A PREFERRED EMBODIMENT

Figure 1:
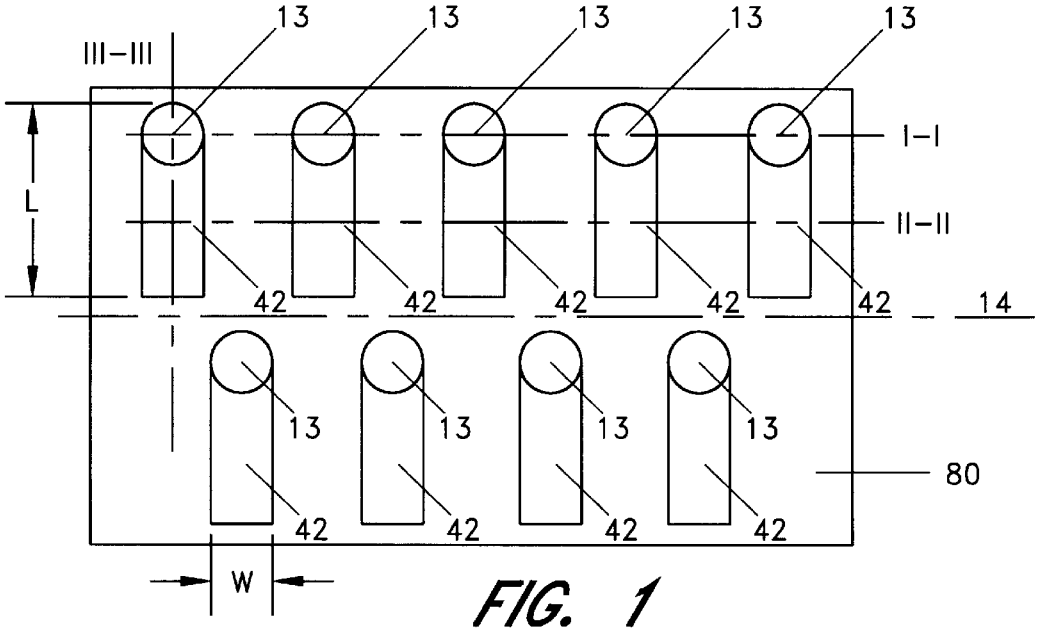
FIG. 1 is a partial plane view of a printhead structure according to a preferred embodiment of the present invention.
Figure 2:
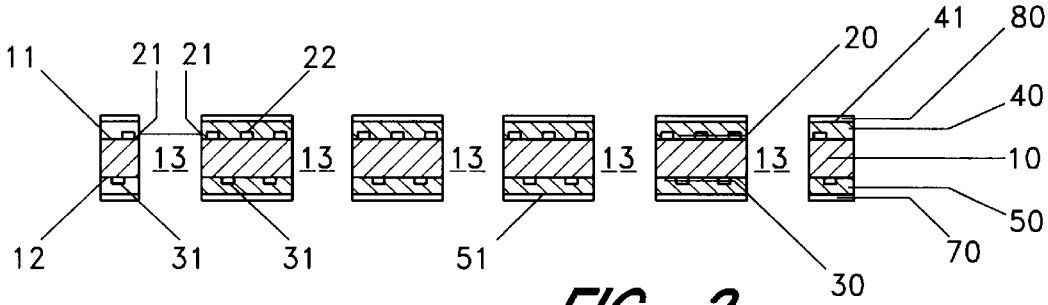
FIG. 2 is a section view across the transversal section line I—I of FIG. 1, showing the different layers comprised in the printhead structure.
Figure 3:
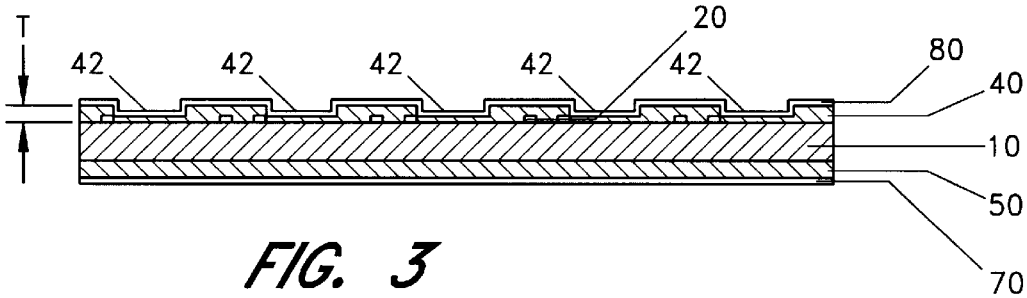
FIG. 3 is a section view across the transversal section line II—II of FIG. 1, showing the different layers comprised in the printhead structure.
Figure 4:
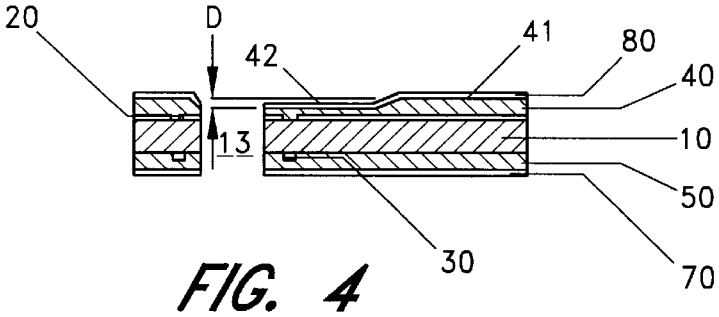
FIG. 4 is a section view across the longitudinal section line III—III of FIG. 1, showing the different layers comprised in the printhead structure.
Figure 5:
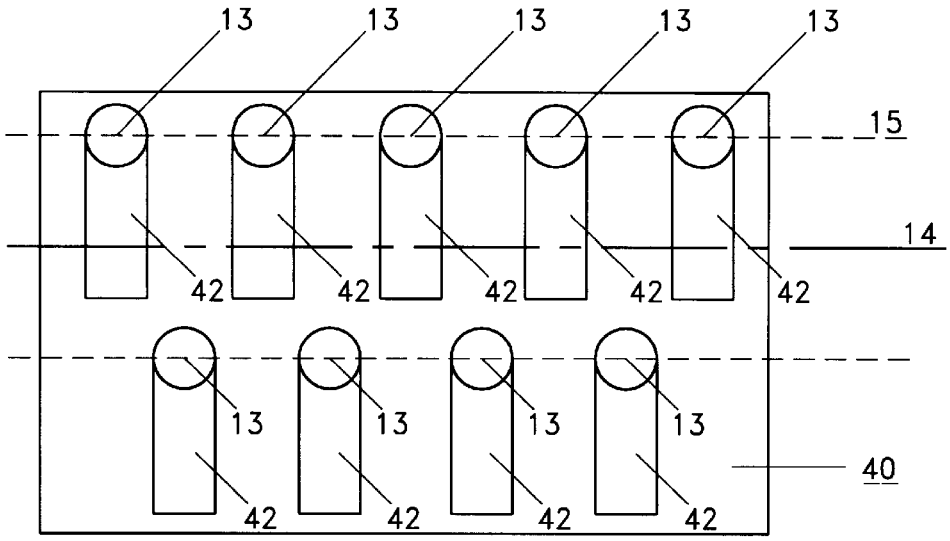
FIG. 5 is a partial plane view of a first cover layer included in the printhead structure of FIG. 1.
Figure 6:
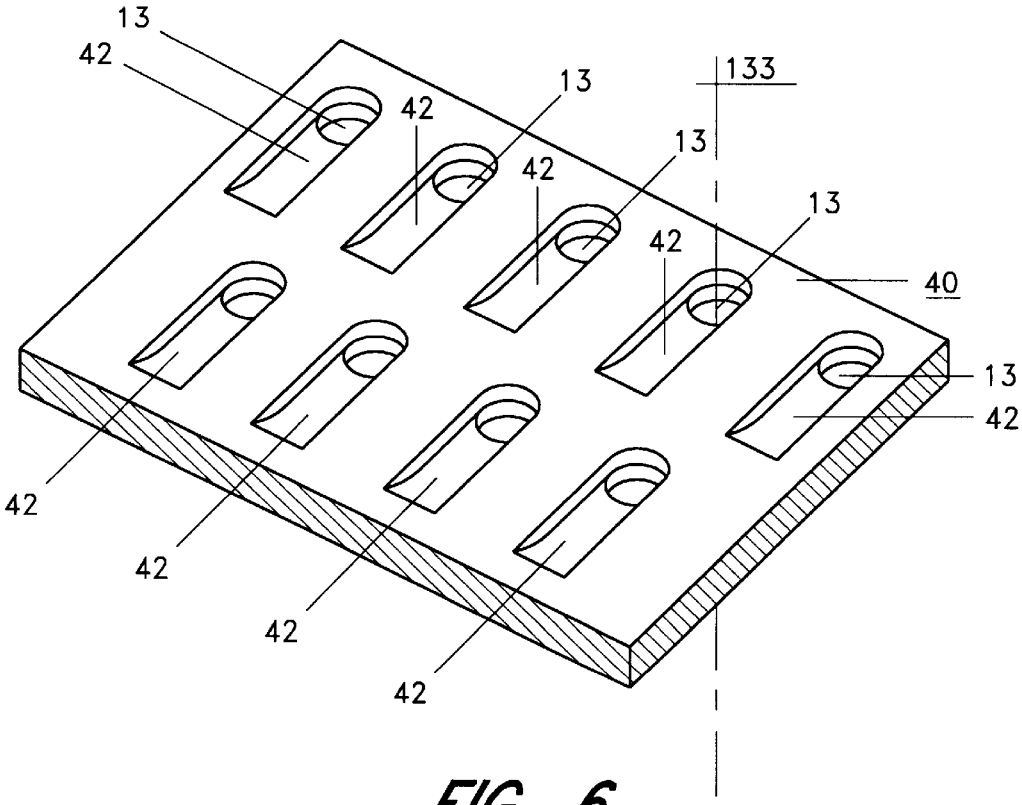
FIG. 6 is a partial perspective view of the cover layer shown in FIG. 5.

In accordance with a preferred embodiment of the present invention, a printhead structure 1 is arranged between a toner particle source S and an image receiving medium M (see FIG. 11). The image receiving medium M, for example, a sheet of paper or an image transfer belt, is caused to move in a first direction, hereinafter referred as longitudinal direction, relative to the particle source. The toner particle source S is generally a rotating, substantially cylindrical toner carrier having an outer surface coated with a toner layer, and a rotation axis extending in a second direction, perpendicular to the first direction, and hereinafter referred as transversal direction.

According to a preferred embodiment of the present invention, shown in FIG. 1–10, the printhead structure 1 comprises the following features:

1. A substrate 10 of flexible, electrically insulating polymer material, such as polyimide, having a predetermined thickness, a first surface 11 facing the toner carrier, a second surface 12 facing the image transfer belt, a transversal axis 14 extending across the print area.

2. A first cover layer 40 of electrically insulating material arranged on the first surface II of the substrate 10, which first cover layer 40 has an initial thickness T, a top surface 41 facing the toner carrier, and embossments carved in the initial thickness to provide a relief on the top surface of the cover layer, the relief comprising areas sunken with respect to the top surface 41, hereinafter referred as depression areas 42.

3. A first printed circuit 20, arranged between the substrate 10 and the first cover layer 40, which first printed circuit includes control electrodes 21 and shield electrodes 22.

4. A second cover layer 50 of electrically insulating material arranged on the second surface 12 of the substrate 10, which second cover layer 50 has a bottom surface 51 facing the image transfer belt.

5. A second printed circuit 30, arranged on the second surface 12 of the substrate 10, which second printed circuit includes segmented deflection electrodes 31.

The printhead structure further includes a plurality of apertures 13 arranged through the printhead structure 1, (i.e. through the substrate 10, the first and second printed circuits 20, 30, and the first and second cover layers 40, 50), to enable passage of toner particles from the toner carrier toward the image transfer belt. Each aperture 13 has a first orifice located in a depression area 42, thus sunken with respect to the top surface 41 of the first cover layer 40, a second orifice facing the image transfer belt, a central axis 133 through the printhead structure 1, and a cross section in a plane perpendicular to the central axis 133. The apertures 13 are aligned in several parallel rows, preferably aligned in two parallel transversally extending rows 15, 16, arranged on each side of the transversal axis 14 of the substrate 10 and transversally shifted with respect to each other.

The printhead structure further includes:

6. A semiconductive layer (SCL) 70 coated on at least a portion of the bottom surface 51 of the second cover layer 50; and 7. A spacer layer 80 of wear resistant diamond-like material, such as amorphous carbon, arranged on at least a portion of the top surface 41 of the first cover layer 40.

Figure 13:
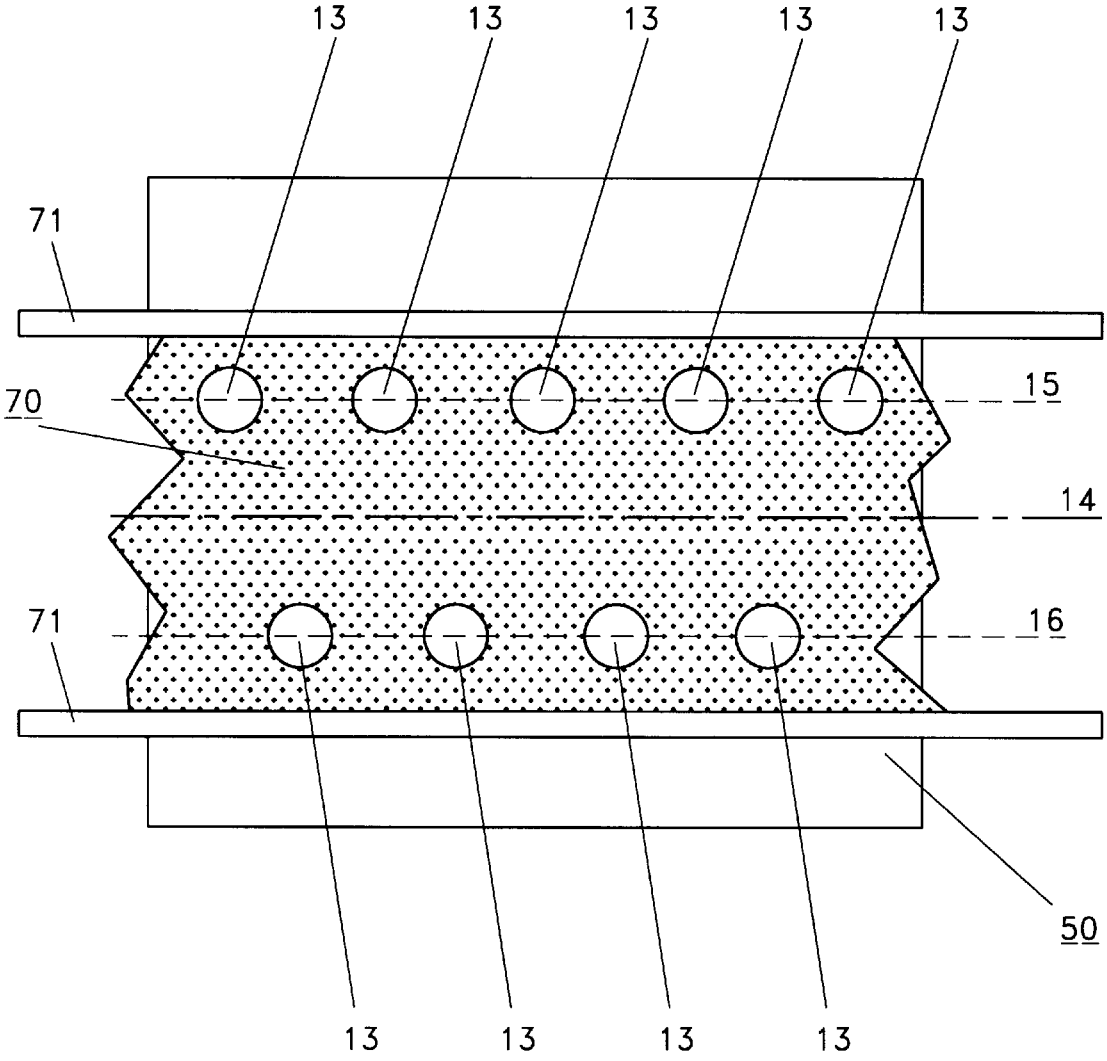
FIG. 13 is a schematic view of the contact surface (dashed area) shown in FIG. 12*a*.

As illustrated in FIG. 11–13, the spacer layer 80 has a contact surface 81 brought in direct contact with the toner layer on the outer surface of the toner carrier. The contact surface 81 surrounds at least a part of each depression area 42. The contact surface 81 extends preferably on each transverse side of each depression area 42, and on a upstream side of each depression area 42 with respect to the rotation of the toner carrier.

Figure 16:
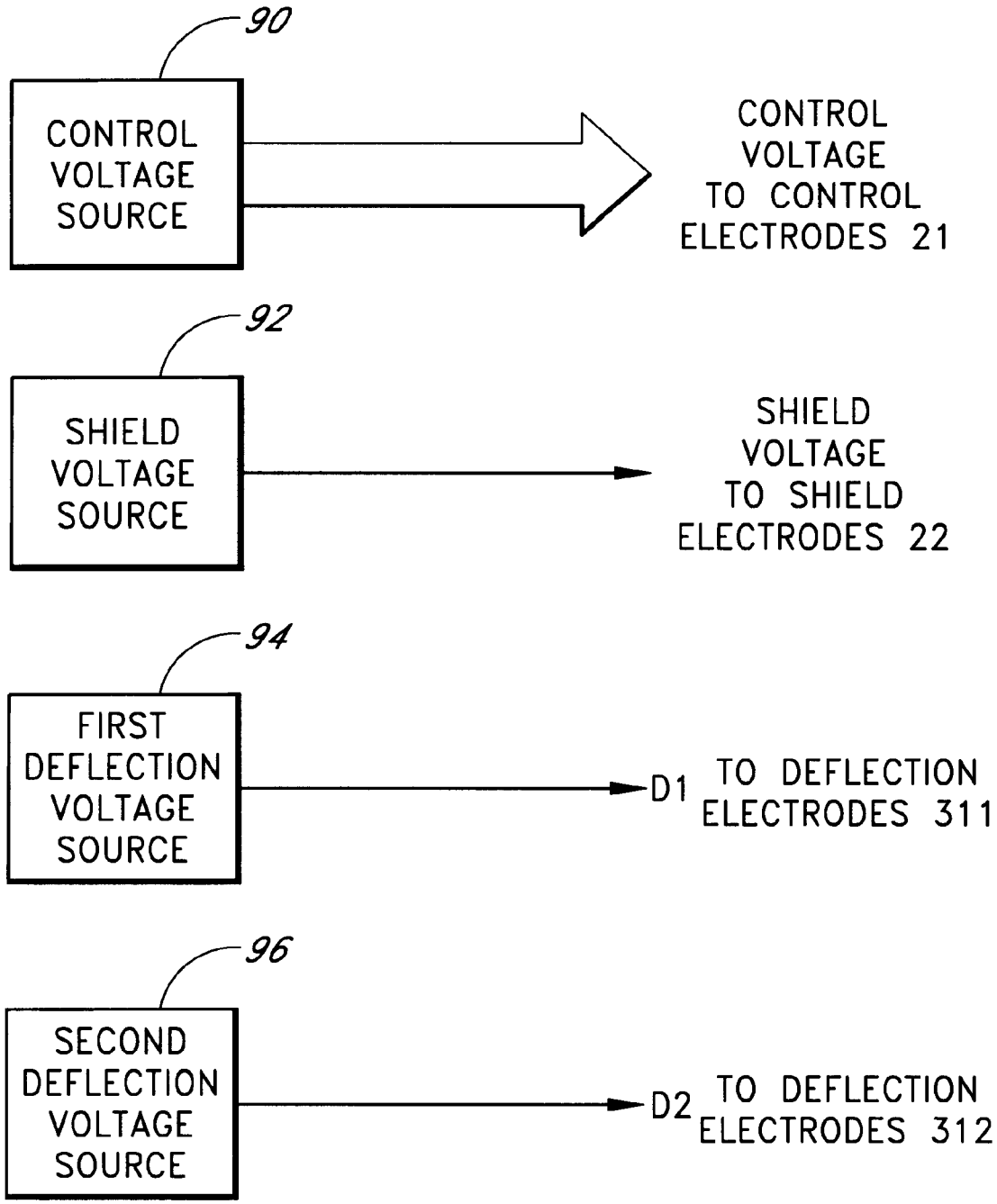
FIG. 16 illustrates a block diagram of the voltage sources which control the printhead structure.

The printhead structure is brought in cooperation with:

8. Variable control voltage sources 90 (FIG. 16) connected to the control electrodes 21 to supply control potentials which control the amount of toner particles to be transported from the toner layer through the apertures 13 toward the image transfer belt.

9. At least one shield voltage source 92 (FIG. 16) connected to the shield electrodes 22 to supply a shield potential to electrostatically screen the control electrodes 21 from one another.

10. Deflection voltage sources 94, 96 (FIG. 16) connected to the deflection electrodes 31 to supply deflection voltage pulses to the deflection electrodes.

In a preferred embodiment of the present invention, the substrate 10 is a flexible sheet of electrically insulating material, such as polyimide, having a thickness on the order of about 50 microns. The first and second printed circuits 30, 50 are copper circuits of approximately 8–9 microns thickness etched onto the first and the second surface 11, 12 of the substrate 10, respectively, using conventional etching techniques. The first cover layer 40 is a sheet of electrically insulating material such as polyimide, parylene or any other suitable material, laminated onto the first surface 11 of the substrate 10, using vacuum, adhesive or any other suitable method. The first cover layer 40 has an initial thickness T of about 10 microns to about 40 microns, depending on dielectric properties. The second cover layer 50 is a 10 to 40 microns thick sheet of insulating material such as polyimide, parylene or the like, laminated onto the second surface 12 of the substrate 10.

The apertures 13 are made through the printhead structure using conventional laser micromachining methods. The apertures 13 have preferably a circular or elliptical cross section perpendicular to the central axis 133, with a diameter from about 80 microns to about 120 microns, preferably from about 90 microns to about 110 microns. Although the apertures 13 have preferably a constant diameter along their central axis, i.e. a substantially cylindrical shape, it may be advantageous to provide apertures 13 whose diameter varies continuously or step wise along the central axis 133, for example, to obtain a conical aperture shape.

In a preferred embodiment of the present invention, the printhead structure 1 is dimensioned to perform 600 DPI printing utilizing three deflection sequences in each print cycle, which implies that three pixel locations are addressable through each aperture 13 of the printhead structure 1 during each print sequence. This can be achieved by applying different deflection signals which slightly deflect the transported toner particles from their initial trajectories toward predetermined pixel locations, so as to obtain a deflected dot on each transverse side of a central, undeflected dot.

Accordingly, the printhead structure 1 is dimensioned so as to provide one aperture 13 for every third pixel location in a transverse direction. That is, 600 DPI print resolution requires a printhead structure 1 having 200 apertures per inch in transverse direction. The apertures 13 are preferably aligned in two parallel rows 15, 16, such that each row comprises 100 apertures per inch. Hence, the distance between central axes 133 of two neighboring apertures 13 of a same row is 0.01 inch, or about 254 microns. The apertures 13 have a diameter on the order of about 80 microns to about 120 microns, the space between two adjacent apertures 13 of a same row is subsequently on the order of about 134 microns to about 174 microns. Hence, the apertures have no overlap in transversal direction. A spacer can be provided in a longitudinal direction in the space between each aperture to obtain an accurate positioning of the printhead structure in relation to the toner carrier. The rows 15, 16, are positioned on each side of the transversal axis 14 of the substrate 10 and are transversally adjusted with respect to each other, such that the apertures 13 are equally spaced in a transverse direction in order to ensure complete coverage of the image transfer belt. The distance between the rows 15, 16 is dimensioned to correspond to a whole number of pixel locations. In embodiments wherein several resolution modes can be selected, the distance between the rows can be adjusted to the resolution modes, for example, 200 dpi, 400 dpi and 600 dpi. In that case, the distance between the rows 15, 16, corresponds to a whole number of pixel locations in all selectable resolution modes, for example, 0.015 inch corresponding to nine 600 dpi pixel locations, six 400 dpi pixel locations or three 200 dpi pixel locations.

Each control electrode 21 has a ring-shaped structure surrounding a corresponding aperture 13 and a part, preferably extending in the longitudinal direction, connecting the ring-shaped structure to a corresponding control voltage source 90. Although a ring-shaped structure is preferred, the control electrodes 21 may take on various appropriate shapes for entirely or partly surrounding the apertures, preferably shapes having symmetry about the central axis 133 of the apertures 13.

Figure 7:
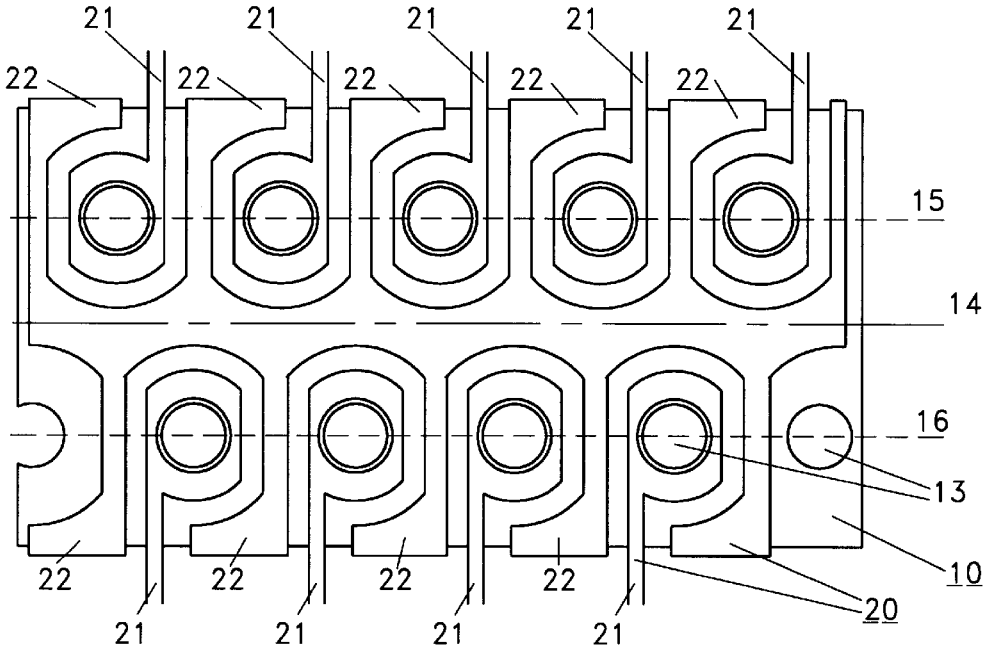
FIG. 7 is a partial plane view of a first printed circuit arranged between the first cover layer (not shown) and a substrate, included in the printhead structure of FIG. 1, which first printed circuit includes shield electrodes and control electrodes.
Figure 8:
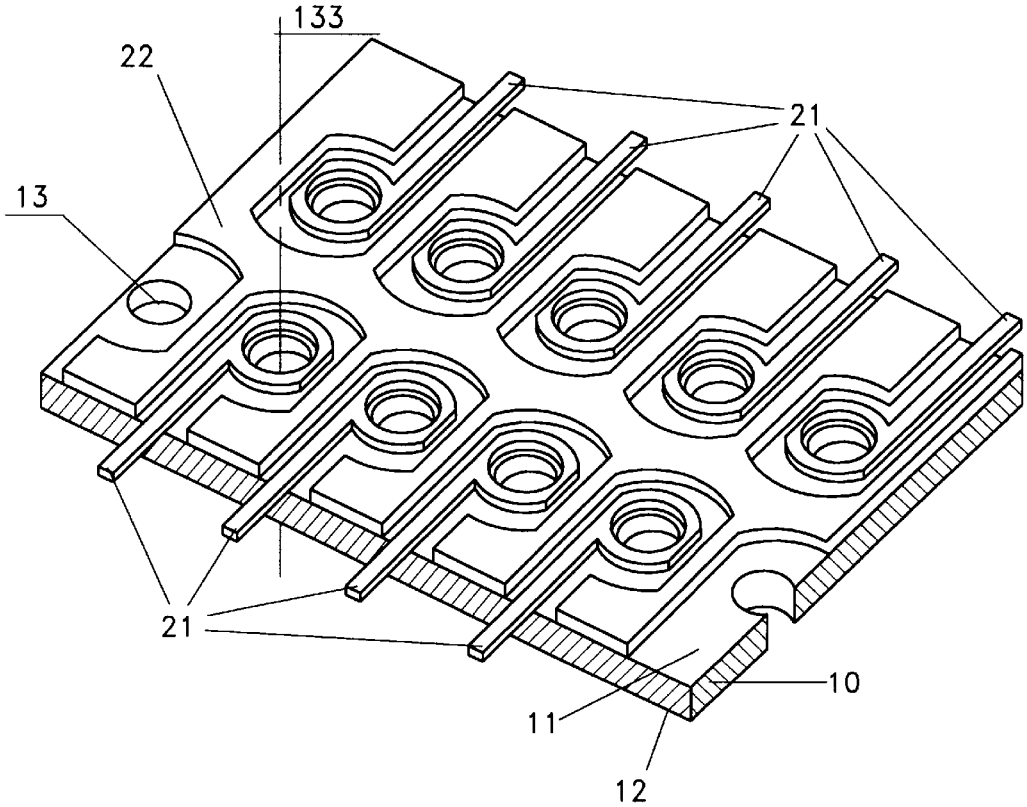
FIG. 8 is a partial perspective view of the first printed circuit and the substrate shown in FIG. 7.

In some embodiments, the control electrodes 21 are made smaller in the transverse direction than in the longitudinal direction to reduce the transversal overlap between control electrodes 21 of different rows. For example, as illustrated in FIGS. 7 and 8, the control electrodes 21 may have a substantially rectangular structure having a circular opening arranged in front of the aperture 13.

The shield electrodes 22 extend transversally between the aperture rows 15, 16 to electrically shield the aperture rows 15, 16, from one another. The shield electrodes 22 preferably have segments extending longitudinally between adjacent apertures 13 of each row. The shield electrodes are set to a shield potential from the voltage source 92 which reduces disturbance of the toner particle layer passing between the apertures, so as to concentrate the influence of the control electrodes on the toner particle layer in the vicinity of the apertures.

Each deflection electrode 31 is divided into two semicircular or crescent shaped deflection segments 311, 312 spaced around a predetermined portion of the circumference of the apertures 13. Although an arcuate shape is preferred, the deflection segments may take on various appropriate shapes for surrounding a predetermined portion of the apertures 13, preferably shapes having symmetry about the central axis 133 of the apertures 13. In a preferred embodiment, a first segment 311 and a second segment 312 are arranged symmetrically on each side of a deflection axis 314 extending through the center of the corresponding aperture 13 at a predetermined deflection angle d to the belt direction. The deflection angle d is dimensioned with respect to the number of deflection sequences performed in each print cycle in order to neutralize the effects of the belt motion during the print cycle to obtain transversally aligned dot locations. In effect, since the image transfer belt moves at a velocity corresponding to one pixel location per print cycle, the first printed dot has to be deflected obliquely upstream with respect to the belt motion, the second printed dot is undeflected, i.e. directed along the central axis 133 of the aperture 13, and the third printed dot has to be deflected obliquely downstream with respect to the belt motion in order to deposit the deflected dots in a transversal alignment on each side of the central, undeflected dot. Accordingly, when using three deflection sequences, the deflection angle d can be evaluated to about 18.4°. When using only two deflection sequences, the deflection angle d is evaluated to about 26.6°. In some embodiments, it can be advantageous to utilize a same printhead structure in two different deflection modes depending on the required print resolution. For example, a printhead structure can be used for 600 DPI printing by performing two deflection sequences per print cycle, and used for 400 DPI printing by performing two deflection sequences per print cycle. In such a case, the deflection angle d is preferably chosen to an optimal value in order to minimize the dot location error in both deflection modes.

Figure 9:
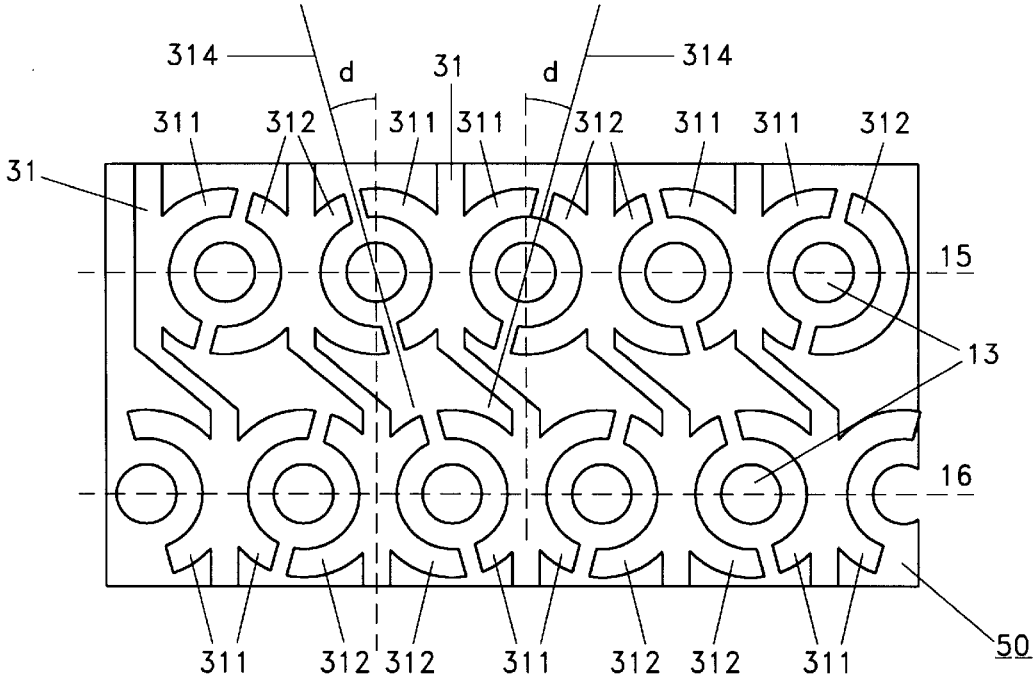
FIG. 9 is a partial plane view of a second printed circuit arranged between the substrate (not shown) and a second cover layer, included in the printhead structure of FIG. 1, which second printed circuit includes segmented deflection electrodes.
Figure 10:
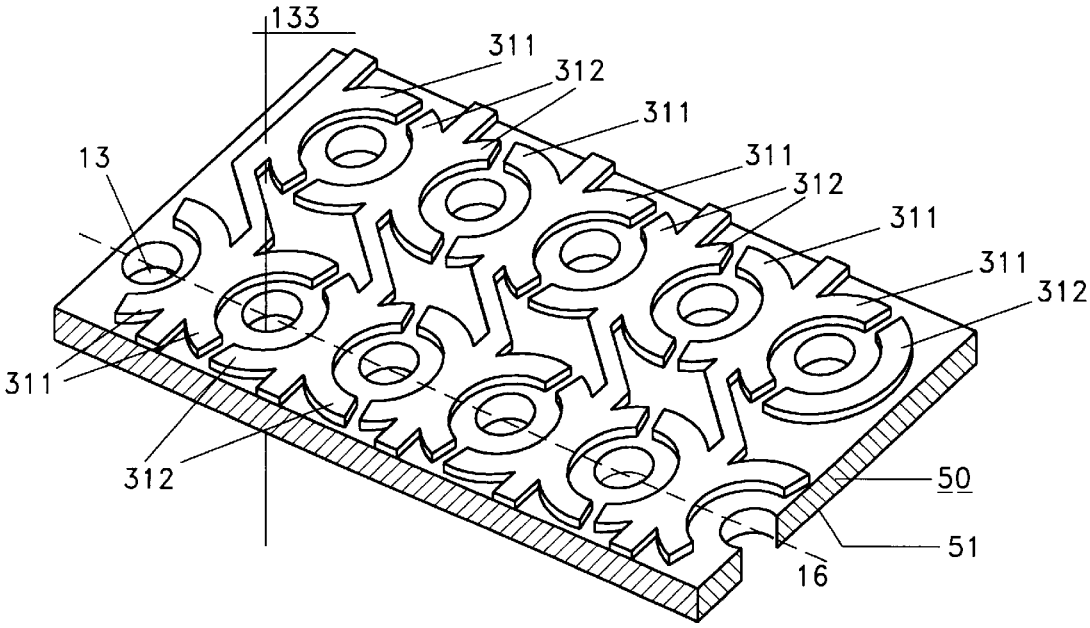
FIG. 10 is a partial perspective view of the second printed circuit and the second cover layer shown in FIG. 8.

In a preferred embodiment of the invention, as apparent from FIGS. 9–10, the deflection electrodes 31 are positioned so as to perform a first deflection sequence in which every second aperture addresses a left pixel location, while the remaining every second aperture addresses a right pixel location. The deflection axes 314 are alternately shifted with respect to the belt direction so as to provide a left-upstream segment and a right-downstream segment in conjunction with every second aperture and a right-upstream segment and a left-downstream segment in conjunction with the remaining every second aperture. All upstream segments 311 are connected to the first deflection voltage source 94 through connectors extending longitudinally on the upstream side of the apertures. All downstream segments 312 are connected to the second deflection voltage source 96 through connectors extending longitudinally on the downstream side of the apertures. The first and second deflection sources 94, 96 supply a first deflection potential D1 and a second deflection potential D2, respectively. When printing with toner particles having negative charge polarity, the first deflection sequence is performed using a first deflection potential difference D1<D2, deflecting transported toner particles in a first upstream direction substantially perpendicular to the deflection axis of each aperture. Similarly, deflection in the opposite direction can be achieved by reverting the first deflection potential difference to D1>D2.

The first cover layer 40 has a top surface 41 facing the particle source, an initial thickness on the order of about 25 microns to about 40 microns, and depression areas 42 sunken in the initial thickness. A depression area 42 is an embossment carved in the thickness of the cover layer 40, having a length L in the longitudinal direction, a width W in the transversal direction, and a depth D with respect to the top surface. The depression areas 42 are preferably obtained utilizing Excimer laser micromachining methods in which UV radiation is delivered on the top surface of the cover layer at repetition rate up to 100 Hz, whereby the incident energy is absorbed in a thin layer (e.g., 0.1 $\mu$m) which is rapidly decomposed, heated and ablated. Each incident laser pulse removes a well defined thin layer of material so that depth control of the depression area can be very exact. One of the main advantages of excimer laser micromachining techniques is that they can be used in a mask projection mode to transfer a complex pattern onto the workpiece, allowing an exact shape control of the depression areas.

The apertures 13 are located in a corresponding depression area 42, such that the first orifice of the aperture is spaced a distance D from the top surface of the first cover layer. The depression length L is larger than the aperture diameter, for example, from about 200 microns to about 2000 microns depending of the type of toner carrier utilized in the printing process. The depression width W is substantially equal to the aperture diameter, i.e., on the order of 100 microns. The depression depth D is smaller than the initial thickness of the first cover layer, for example, from about 5 microns to about 30 microns. The depression areas 42 extend longitudinally on the downstream side of each aperture 13 with respect to the rotation of the toner carrier.

In some embodiments, the depression depth D is substantially constant along the whole depression length L, forming a trench-shaped depression area. The depression depth D may also be variable along the depression length or along a part of the depression length, forming a ramp-shaped depression area as that shown in FIG. 6. For example, the depression depth D may have a maximal value in the vicinity of the aperture, and decrease continuously in the longitudinal direction. The depression area has a substantially rectangular shape having a width coinciding with the transverse diameter of the aperture and a length extending on the downstream side thereof. To provide a smooth relief without sharp transversal edges, the depression area 42 is preferably ramp-shaped, with a depression depth decreasing continuously in the longitudinal direction from a maximal value, for example, 30 microns, in the vicinity of the aperture 13.

The semiconductive layer 70 (SCL) is a film of semiconductive material, such as silicium oxide or any other suitable material, having a thickness on the order of about 1 micron and a resistivity is on the order of $1.7 \cdot 10^{11}$ Ω/square to about $5 \cdot 10^{11}$ Ω/square. The SCL 70 is coated on the bottom surface of the second cover layer 50 to cover the aperture rows 15, 16, such that all apertures 13 are surrounded by the SCL 70. The SCL 70 extends transversally across the print area, and has a width of approximately 10 mm in the longitudinal direction. A strip 71 of conductive material, such as, for example, aluminum, extends transversally on each side of the SCL 70. The strips 71 arc set on an electric potential to drain undesired charge agglomeration from the SCL surface to prevent residual toner particles from obstructing the apertures or influencing the toner transport trajectory.

The control voltage sources 90 are conventional IC drivers supplying variable control voltage pulses to the control electrodes to produce a pattern of electrostatic control fields which selectively permit or restrict the passage of toner particles through the apertures during each print sequence. Each control voltage pulse can be amplitude and/or width modulated to control the amount of toner allowed to pass through a selected aperture, (dot density control). For example, the amplitude modulation can be performed in a range from about −50V corresponding to non-print condition (white voltage) to about +325 V corresponding to full density print condition (black voltage). The pulse-width modulation can be performed in several steps each corresponding to a specific shade to improve grey-scale capabilities. The deflection voltage sources supply deflection voltage pulses to the deflection electrodes to modify the symmetry of the electrostatic control fields about the central axes of the apertures, thereby deflecting the transported toner particles toward an intended pixel position (dot position control). The deflection segments are disposed symmetrically about the central axis of an aperture, whereby the toner transport trajectory is unaffected as both deflection potentials D1, D2 have the same amplitude. The amplitude of the deflection voltage pulses can be modulated in order to apply focusing forces which cause all transported toner particles to converge onto an intended pixel locations (dot size control). The shield voltage source is connected to the shield electrodes to supply a shield potential, for example, 0 V, which reduces undesired interaction between neighboring electrodes (cross coupling), and concentrates the control electrode fields in the vicinity of the apertures.

The spacer layer 80 is a thin film of diamond-like material, such as amorphous carbon, having a thickness in a range of from about 50 nanometers to about 200 nanometers, and preferably from about 100 nanometers to about 150 nanometers. The spacer layer 80 is coated on the top surface of the first cover layer 40 so as to cover the aperture rows 15, 16 and the depression areas 42. The spacer layer 80 covers even a part of the inner walls of the apertures 13 in the vicinity of the depression areas 42. The spacer layer 80 has a transversal extension over the whole print area and an longitudinal extension, for example, about 10 mm on each side of the aperture rows 15, 16. The spacer layer 80 has a contact surface 81 which, during the print process, is brought in contact with the outer surface of the toner carrier, so as to press the toner layer between the contact surface 81 of the spacer layer 80 and the outer surface of the toner carrier. The contact surface 81 has a small longitudinal extension, for example, up to 2 mm, over the aperture rows. The contact surface 81 is obtained by uniformly tensioning the flexible printhead structure 1 against the toner carrier, as schematically illustrated in FIG. 11, the tensioning force being applied in a plane joining the rotation axis of the toner carrier and a transversal contact axis of the printhead structure 1. The transversal contact axis preferably extends between the aperture rows 15 16, or, in some embodiments, on the upstream side of the rows with respect to the rotation direction. Since the toner layer is conveyed in frictional contact along the longitudinal extension of the contact surface 81, the frictional forces between toner particles and the spacer layer 80 have to be lower than the adhesion forces holding the toner particles on the outer surface of the toner carrier to prevent toner particles from being removed from the toner carrier. The surface roughness of the spacer layer 80 has to be sufficiently low to prevent toner particles from adhering on the spacer layer. Therefore, the spacer layer material is selected to have sufficiently low friction coefficient and sufficiently low surface roughness, depending of the shape, size and charge of the toner particles utilized. Further, in order to facilitate the transport of toner over the contact surface, the spacer layer 80 has a resistivity in a range of $10^{10}$ Ω/square to $10^{12}$ Ω/square, preferably about $1.5 \cdot 10^{11}$ Ω/square. The composition of the spacer layer material can be varied to meet the specific requirements associated with the kind of toner and toner carrier used in the process. For example, the spacer layer material can be selected among amorphous carbon, hydrogenated amorphous carbon comprising, for example, from 1 to about 60 weight percent of hydrogen, or halogenated amorphous carbon including chlorinated or fluorinated amorphous carbon and preferably fluorinated amorphous carbon wherein the halogen is present in an effective amount of, for example, from about 1 to about 40 weight percent and preferably from about 1 to about 20 weight percent. Amorphous carbon films can be deposited on polyimide substrate utilizing a method known as Laser-arc and described in "Surface and Coating Technology" 85 (1996) 209–214. The laser-arc evaporation process allows an industrial high-rate deposition of amorphous carbon of diamond-like nature. Deposition rates above 3 nanometers per second can be performed. The basic process consists of pulsed cathodic vacuum arc ignited by focused laser pulses. By limiting the arc pulse duration between 20 and 100 microseconds, the arc spot erodes only a definite region surrounding its ignition point, the laser focus. The arc spot position is controlled by the displacement (scanning) of the laser focus on the rotating cylindrical cathode, allowing its systematic erosion. With cathodes composed of different materials, multilayered film structures can be realized with easily changed variations. Owing to the low deposition temperature, below 150° C., the method is particularly suitable for temperature-sensitive substrate materials.

Figure 14:
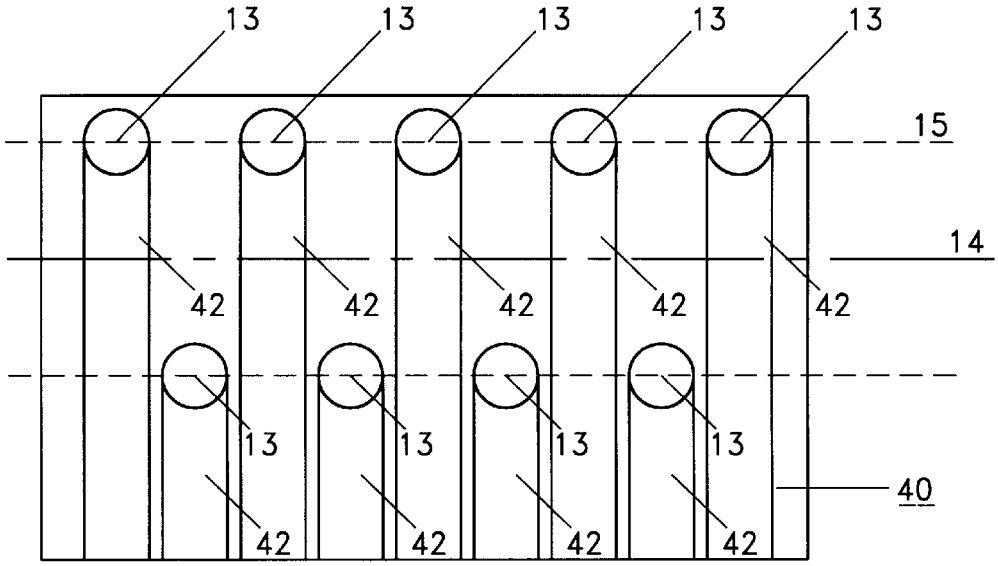
FIG. 14 is a partial plane view of the printhead structure of FIG. 1, showing the part of the printhead structure facing the image receiving medium and a semi-conductive layer arranged on the second cover layer.
Figure 15:
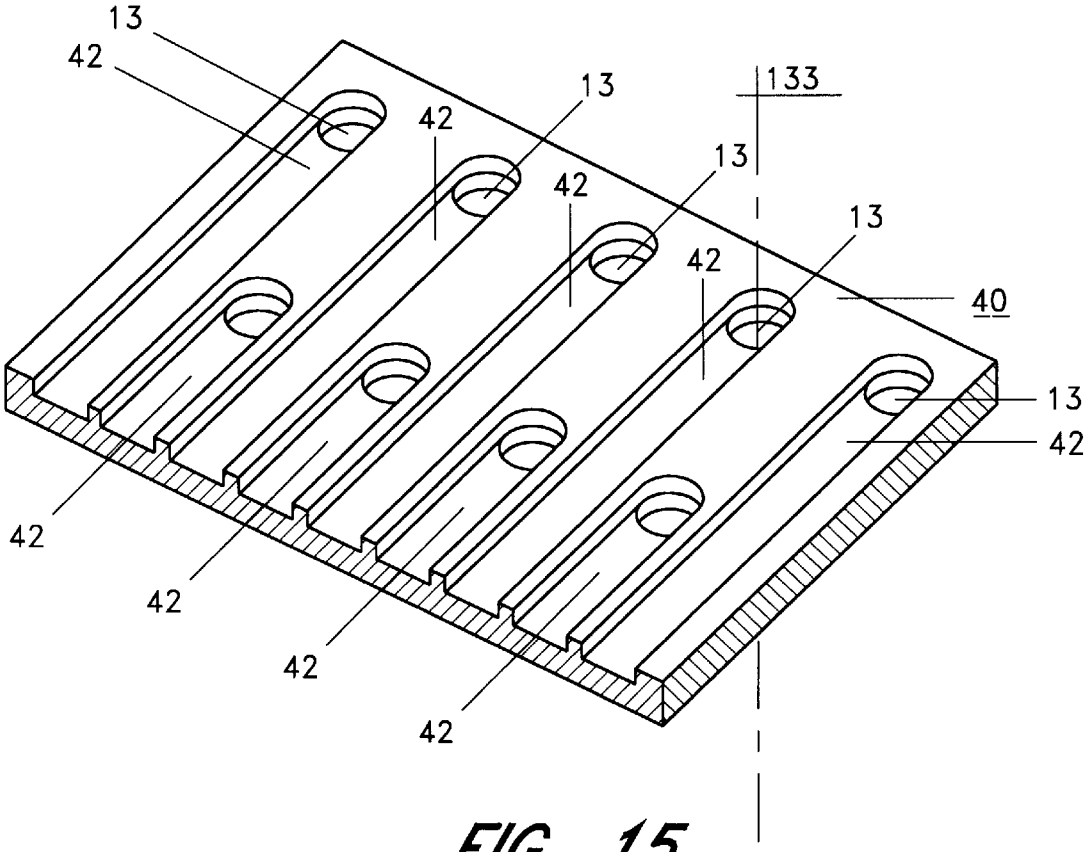
FIG. 15 shows an alternate embodiment of the printhead structure of FIG. 1, in which depression areas are arranged longitudinally from the apertures to form tracks over which the printhead structure is spaced from the toner particle carrier.

According to another embodiment of the present invention, shown in FIGS. 14–15, the depression areas 42 are aligned in parallel tracks extending longitudinally on the whole downstream side of each aperture 13, so as to obtain a contact surface extending between each aperture and on the upstream side of the apertures.

In an alternate embodiment of the invention (not shown), the substrate and both cover layer are embedded in a coating of insulating material, such as parylene, covering the top surface of the first cover layer, the bottom surface of the second cover layer and at least a part of the inner walls of the apertures. The spacer layer and the SCL are then coated over the parylene coating on the top surface of the first cover layer and on the bottom surface of the second cover layer, respectively.

The foregoing description should be taken as illustrative and not as strictly limited to the specific embodiment described herein.

What is claimed is:

1. A printhead structure in an image recording apparatus which includes a toner particle source for delivering charged toner particles to an image receiving medium, said printhead structure being arranged between the toner particle source and the image receiving medium to modulate a transport of toner particles from the particle source to the image receiving medium, said printhead structure comprising:

a substrate of electrically insulating material having a first surface abutting the toner particle source and a second surface facing the image receiving member;

a first cover layer of electrically insulating material arranged on said first surface of the substrate;

a plurality of apertures arranged in depression areas through the printhead structure;

a first printed circuit including control electrodes arranged between said substrate and said first cover layer to control the transport of toner through the apertures; and a spacer layer of wear-resistant material at least partially coating the first cover layer and in contact with the toner particles to space the first cover layer from the toner particles on the toner particle source.

2. The printhead structure of claim 1, wherein the spacer layer is a film of diamond-like nature.

3. The printhead structure of claim 2, wherein the spacer layer comprises amorphous carbon.

4. The printhead structure of claim 2, wherein the spacer layer comprises a film of hydrogenated amorphous carbon having from about 1 to about 60 weight percent of hydrogen.

5. The printhead structure of claim 2, wherein the spacer layer comprises a film of halogenated amorphous carbon wherein the halogen is present in an effective amount of from about 1 to about 40 weight percent.

6. The printhead structure of claim 2, wherein the spacer layer comprises a film of halogenated amorphous carbon wherein the halogen is present in an effective amount of from about 1 to about 20 weight percent.

7. The printhead structure of claim 2, wherein the spacer layer comprises a film of fluorinated amorphous carbon having from about 1 to about 40 weight percent of fluorine.

8. The printhead structure of claim 2, wherein the spacer layer comprises a film of fluorinated amorphous carbon having from about 1 to about 20 weight percent of fluorine.

9. The printhead structure of claim 2, wherein the spacer layer has a thickness in a range from about 50 nanometers to about 200 nanometers.

10. The printhead structure of claim 2, wherein the spacer layer has a thickness in a range from about 100 nanometers to about 150 nanometers.

11. The printhead structure of claim 1, wherein the first cover layer has an initial thickness facing the particle source, said first cover layer having depression areas arranged in said initial thickness.

12. The printhead structure of claim 11, wherein the apertures through the printhead structure are arranged in the depression areas, the part of the apertures facing the particle source being sunken in said initial thickness of the first cover layer.

13. The printhead structure of claim 11, wherein the depression areas extend at a predetermined depth in the initial thickness of the first cover layer, wherein each aperture through the printhead structure is arranged in a corresponding depression area, the part of the apertures facing the particle source being sunken a distance in the initial thickness of the first cover layer.

14. The printhead structure of claim 11, wherein the toner particle source comprises a rotating toner particle carrier having a rotation axis extending in a first direction and an outer surface coated with a toner particle layer, the spacer layer being tensioned against said outer surface of the toner particle carrier, whereby said toner particle layer is brought in contact with the spacer layer over a predetermined contact surface of the spacer layer, and the apertures through the printhead structure are arranged in depression areas, the part of the apertures facing the particle source being thereby spaced from said toner particle layer.

15. The printhead structure of claim 14, wherein the apertures are arranged in at least two parallel rows extending in said first direction.

16. The printhead structure of claim 14, wherein said contact surface of the spacer layer at least partially surrounds each of said depression areas.

17. The printhead structure of claim 14, wherein the depression areas are arranged in at least two parallel rows extending in said first direction, and said contact surface of the spacer layer extends between the depression areas of each row.

18. The printhead structure of claim 14, wherein the depression areas are arranged in at least two parallel rows extending in said first direction, and said contact surface of the spacer layer extends on a upstream side of each depression area with respect to the rotation of the toner particle carrier.

19. The printhead structure of claim 14, wherein said contact surface of the spacer layer extends between the depression areas of each row.

20. The printhead structure of claim 14, wherein the depression areas are arranged in at least two parallel rows extending in said first direction, and the depression areas have substantially the same extension as the apertures in said first direction.

21. The printhead structure of claim 14, wherein each aperture is arranged in a corresponding depression area, the depression areas having substantially the same extension as the apertures in said first direction, each depression area extending on the downstream side of a corresponding aperture with respect to the rotation of the toner particle carrier, and said contact surface of the spacer layer extending on a upstream side of each aperture with respect to the rotation of the toner particle carrier.

22. The printhead structure of claim 21, wherein each depression area extends at a predetermined depth with respect to said contact surface of the spacer layer, said predetermined depth being substantially constant in a second direction, said second direction being perpendicular to said first direction.

23. The printhead structure of claim 21, wherein each depression area extends at a predetermined depth with respect to said contact surface of the spacer layer, and said predetermined depth decreases in a second direction, perpendicular to said first direction, from a maximal value in the vicinity of the aperture.

24. The printhead structure of claim 21, wherein the depression areas are similarly spaced, parallel tracks extending in a second direction, perpendicular to said first direction, on a downstream side of the apertures with respect to the rotation of the toner particle carrier, the contact surface of the spacer layer extending between said tracks.

25. The printhead structure of claim 1, wherein a portion of each control electrode of the first printed circuit at least partially surrounds a corresponding aperture, each control electrode being connected to a variable voltage source supplying control voltage pulses which permit or restrict the transport of toner particles from the toner particle source through the corresponding aperture in accordance with an image information.

26. The printhead structure of claim 25, wherein the first printed circuit further comprises at least one shield electrode extending between said control electrodes, said shield electrode is connected to a shield voltage source supplying a shield potential to electrostatically shield said control voltage pulses from one another, thereby preventing interference between adjacent control electrodes.

27. The printhead structure of claim 25, wherein the apertures are arranged in at least two parallel rows extending in a first direction, the portion of the control electrodes surrounding the apertures is smaller in said first direction than in a second direction, the second direction being perpendicular to said first direction.

28. The printhead structure of claim 26, wherein the apertures are arranged in at least two parallel rows extending in a first direction, and the shield electrodes extend substantially in said first direction between said aperture rows.

29. The printhead structure of claim 26, wherein the apertures are arranged in at least two parallel rows extending in a first direction, and the shield electrodes extend substantially in said first direction between said aperture rows and in a second direction between the apertures of each aperture row.

30. The printhead structure of claim 1, further comprising:

a second cover layer arranged on said second surface of the substrate, said second cover layer having a bottom surface facing the image receiving medium; and a second printed circuit comprising segmented deflection electrodes arranged between the substrate and said second cover layer.

31. The printhead structure of claim 30, wherein each segmented deflection electrode has a first deflection segment and a second deflection segment, the segmented deflection electrodes being connected to deflection control means for sequentially producing potential differences between said first and second deflection segments, thereby deflecting toner particles passing through the apertures toward predetermined pixel locations on the image receiving medium.

32. The printhead structure of claim 30, wherein the printhead structure cooperates with an image receiving medium moving in a predetermined direction relative to the printhead structure, in which each aperture has a central axis through the printhead structure, and each segmented deflection electrode has a first deflection segment and a second deflection segment disposed symmetrically about said central axis of a corresponding aperture.

33. The printhead structure of claim 32, wherein each segmented deflection electrode has a first deflection segment and a second deflection segment disposed on each side of a deflection axis extending through said central axis of a corresponding aperture at a predetermined deflection angle to said predetermined direction of the image receiving medium.

34. The printhead structure of claim 33, wherein said deflection angle is in a range of about 10° to about 40°.

35. The printhead structure of claim 33, wherein said deflection angle is in a range of about 18° to 27°.

36. The printhead structure of claim 30, further comprising a layer of semi-conductive material coated on at least a part of said bottom surface of said second cover layer.

37. A method for producing a printhead structure for an image recording apparatus which includes a toner particle source for delivering charged toner particles in a position adjacent to an image receiving medium, wherein the printhead structure is arranged between the toner particle source and the image receiving medium to modulate a transport of toner particles from the toner particle source to the image receiving medium, the method comprising:

providing a substrate of electrically insulating material having a first surface abutting the toner particle source and a second surface;

forming a plurality of apertures in depression areas through the printhead structure;

forming a printed circuit on said substrate proximate to said first surface, said printed circuit comprising a plurality of control electrodes being formed around said apertures;

forming a first cover layer of electrically insulating material on said substrate over said printed circuit, said first cover layer of electrically insulating material having a top surface which faces away from said substrate;

coating at least a portion of said top surface of said first cover layer of electrically insulating material with a spacer layer of wear-resistant material the spacer layer contacting the toner particles to space said top surface from the toner particles when said printhead structure is positioned proximate to the toner particle source.

38. A printhead structure in an image recording apparatus which includes a toner particle source for delivering charged toner particles to an image receiving medium, said printhead structure comprising:

a control electrode array having a first surface abutting the toner particle source; and a spacer layer of wear-resistant material at least partially coating the first surface of the control electrode array and in contact with the toner particles to space the control electrode array from the toner particles on the toner particle source.

* * * * *